US010724200B2

(12) United States Patent
Cascarino et al.

(10) Patent No.: US 10,724,200 B2
(45) **Date of Patent: *Jul. 28, 2020**

(54) DRILLING MACHINE EQUIPPED WITH AN ANCHORING DEVICE ALLOWING THE HORIZONTAL MOVEMENT OF THE DRILLING MODULE IN THE ANCHORED POSITION

(71) Applicant: SOLETANCHE FREYSSINET, Rueil-Malmaison (FR)

(72) Inventors: Sara Cascarino, Rueil-Malmaison (FR); Daniel Perpezat, Rueil-Malmaison (FR); Laurent Pivert, Rueil-Malmaison (FR); Régis Bernasinski, Rueil-Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 176 days.

This patent is subject to a terminal disclaimer.

(21) Appl. No.: 15/758,802

(22) PCT Filed: Sep. 8, 2016

(86) PCT No.: PCT/FR2016/052251

§ 371 (c)(1),
(2) Date: Mar. 9, 2018

(87) PCT Pub. No.: WO2017/042499

PCT Pub. Date: Mar. 16, 2017

(65) Prior Publication Data

US 2019/0085524 A1 Mar. 21, 2019

(30) Foreign Application Priority Data

Sep. 10, 2015 (FR) ..... 15 58428

(51) Int. Cl.
*E02D 17/13* (2006.01)
*E21B 3/00* (2006.01)
(Continued)

(52) U.S. Cl.
CPC ..... *E02D 17/13* (2013.01); *E21B 3/00* (2013.01); *E21B 10/08* (2013.01); *E21B 10/62* (2013.01)

(58) Field of Classification Search
CPC . E02D 17/13; E21B 3/00; E21B 10/08; E21B 10/62
See application file for complete search history.

(56) References Cited

U.S. PATENT DOCUMENTS 3,894,587 A * 7/1975 Sourice ..... E02D 17/13 175/91
4,314,615 A * 2/1982 Sodder, Jr. ..... E21B 4/006 175/106

(Continued)

FOREIGN PATENT DOCUMENTS

| | | |
|---|---|---|
| DE | 10336315 | 3/2005 |
| EP | 0593355 A1 | 4/1994 |
| EP | 0811724 A1 | 12/1997 |

*Primary Examiner* — Jamie L McGowan
(74) *Attorney, Agent, or Firm* — Workman Nydegger; Matthew D. Todd

(57) ABSTRACT

A drilling machine for drilling ground in a vertical direction, the machine including: an anchor module having front and rear faces, the anchor module including an anchor device having front and rear anchor pads that are deployable in a deployment direction, to bear against walls of the excavation to hold the anchor module stationary in the ground. The anchor module further includes: a frame carrying the front and rear anchor pads, the frame supporting the drilling module; and an actuator device to which the front and rear anchor pads are fastened, the actuator device being movable relative to the frame in a movement direction that extends (Continued)

transversely to the longitudinal direction; whereby the assembly constituted by the front anchor pad, the rear anchor pad, and the actuator device is movable in the movement direction relative to the frame and the drilling module.

22 Claims, 7 Drawing Sheets

(51) Int. Cl.
*E21B 10/08* (2006.01)
*E21B 10/62* (2006.01)

(56) References Cited

U.S. PATENT DOCUMENTS 4,824,176 A * 4/1989 Barre ..... E02F 3/205 175/91
5,267,902 A * 12/1993 Arzberger ..... E02D 17/13 464/89
7,367,143 B2 * 5/2008 Stoetzer ..... E02D 17/13 175/91
7,637,038 B2 * 12/2009 Arzberger ..... E02F 3/205 299/34.11
8,640,364 B2 * 2/2014 Arzberger ..... E02D 17/13 37/189
2003/0037464 A1 * 2/2003 Gessay ..... E02D 17/13 37/189
2003/0074810 A1 * 4/2003 Gessay ..... E02D 17/13 37/347
2005/0091885 A1 * 5/2005 Arzberger ..... E21B 4/003 37/347
2014/0225417 A1 * 8/2014 Meinders ..... E02F 5/08 299/39.4
2016/0145825 A1 5/2016 Steff De Verninac et al.

* cited by examiner

DRILLING MACHINE EQUIPPED WITH AN ANCHORING DEVICE ALLOWING THE HORIZONTAL MOVEMENT OF THE DRILLING MODULE IN THE ANCHORED POSITION

BACKGROUND OF THE INVENTION

The present invention relates to the field of drilling in ground, in particular for the purpose of constructing foundations, such as for example continuous screens constituted by juxtaposed concrete wall elements.

The invention relates more precisely to a drilling machine for excavating in ground in a drilling direction that is substantially vertical, and more particularly in hard soil.

More particularly, the invention relates to a machine having both a bottom portion provided with cutter members and also a top portion, the drilling machine presenting a longitudinal direction extending between the top portion and the bottom portion of the drilling machine, the drilling machine comprising:

an anchor module having a front face and a rear face, the anchor module comprising at least one anchor device having at least one front anchor pad arranged on the front face and at least one rear anchor pad arranged on the rear face, the front and rear anchor pads being deployable in a deployment direction that extends transversely to the longitudinal direction of the drilling machine so as to bear against walls of the excavation in order to hold the anchor module stationary in the ground; and a drilling module carrying the cutter members, the drilling module co-operating with the anchor module.

That type of drilling machine is generally used for drilling in hard soil, e.g. in granite. The movement device serves to exert additional thrust on the drilling tools, for the purpose of facilitating excavation.

Such a machine is described in particular in EP 0 811 724. It can be understood that the anchor module serves to hold the drilling machine stationary in the excavation. Nevertheless, that drilling machine does not make it possible effectively to correct the drilling path. Correcting the drilling path of the drilling machine requires its position in the trench to be modified. After modifying its position, the drilling machine is generally no longer centered in the excavation but is closer to one of the larger walls than it is to the opposite wall. Also, deploying anchor pads has the effect of recentering the drilling machine in the excavation, thereby modifying the position of the machine, and consequently once more skewing the drilling path.

OBJECT AND SUMMARY OF THE INVENTION

An object of the present invention is to propose a drilling machine suitable for being anchored without changing the transverse position of the drilling machine in the excavation.

The invention achieves this object by the fact that the anchor device comprises:

a frame carrying the front and rear anchor pads, the frame supporting the drilling module; and an actuator device to which the front and rear anchor pads are fastened, the actuator device presenting a retracted state in which the front and rear anchor pads are retracted, and a deployed state in which the front and rear anchor pads are deployed, the actuator device acting on the front and rear anchor pads while being movable relative to the frame in a movement direction that extends parallel to the deployment direction;

whereby the assembly constituted by the front anchor pad, the rear anchor pad, and the actuator device is movable relative to the frame and to the drilling module in the movement direction.

It can be understood that there exists a sliding connection between the assembly constituted by the front and rear anchor pads together with the actuator device for sliding relative to the frame carrying the drilling module, this sliding connection extending in the movement direction that extends transversely relative to the longitudinal direction. Advantageously, the assembly constituted by the front anchor pad, the rear anchor pad, and the actuator device is movable freely relative to the frame and to the drilling module in the movement direction. This is a so-called "floating" mount.

During anchoring, the actuator device is deployed so as to bring the front and rear anchor pads into the deployed position. For example, if the front anchor pad comes to bear against one of the walls of the excavation before the rear anchor pad, then the actuator device and the rear anchor pad move transversely along the movement direction relative to the frame until the rear anchor pad in turn comes into contact with the opposite wall. The deployment of the front and rear anchor pads and the movement of the actuator device take place relative to the frame and to the drilling module, so it can be understood that the drilling module remains stationary during the anchoring stage. Furthermore, by means of the invention, the front and rear anchor pads are deployed without changing the transverse (usually horizontal) position of the drilling module relative to the walls of the excavation.

In other words, after correctly positioning the drilling module in the ground, the invention makes it possible to anchor the anchor module in the ground without changing the horizontal position of the drilling module. By means of the invention, anchoring does not modify the drilling path.

Amongst other things, the invention thus makes it possible to improve the accuracy of the drilling path.

In a first embodiment of the invention, the actuator device comprises a body fastened to the frame so as to be slidable in a direction parallel to the movement direction. Thus, in this first embodiment, the actuator performs two functions: specifically both moving the front and rear anchor pads, and also guiding the movement of the frame with the drilling module relative to the front and rear anchor pads. In this first embodiment, the actuator device is fastened to the frame so that the sliding connection between the front and rear anchor pads is provided by the actuator device.

Advantageously, the actuator device is an jack having its cylinder fastened to the frame in slidable manner and to one of the front and rear anchor pads, while the rod of the jack is fastened to the other one of the front and rear anchor pads.

In a variant, the actuator device is an jack having its cylinder fastened in slidable manner to the frame, the jack having a first rod fastened to the front anchor pad and a second rod on the same axis as the first rod and fastened to the rear anchor pad.

In a second embodiment, the anchor device further comprises:

a front guide device for guiding the movement of the front anchor pad relative to the frame in the deployment direction; and/or a rear guide device for guiding the movement of the rear anchor pad relative to the frame in the deployment direction.

The front and rear guide devices serve to guide the deployment of the front and rear anchor pads, and also the movement of the anchor pads and of the actuator device relative to the drilling module, which remains stationary during the anchoring stage.

Another advantage of adding front and rear guide devices is to transfer longitudinal forces thereto, thereby dissociating the functions of deploying the pads and of taking up the (vertical) longitudinal forces. This also enables the frame to take up greater longitudinal forces, e.g. associated with the weight of the drilling module, thus having the effect of improving the robustness of the drilling machine.

Preferably, in the second embodiment, the actuator device as such is not directly connected to the frame. This so-called "floating" mount has the effect of enabling the frame to move easily relative to the assembly constituted by the front and rear anchor pads and the actuator device.

In preferred manner, the front guide device includes at least a first front guide member that is fastened to the front anchor pad, the first front guide member being mounted to the frame so as to be slidable along a direction parallel to the deployment direction.

To do this, the frame may include by way of example a hole in which the first front guide member is slidably mounted.

In order to avoid the first guide member being disengaged from the frame, the first front guide member includes an abutment to limit the amplitude of the movement of the first front guide member in the frame.

Preferably, but not exclusively, the abutment is arranged at the end of the first front guide member that is remote from the fastening portion of said first front guide member.

Advantageously, in order to further improve the ability to take up longitudinal forces, the front guide device further includes a second front guide member identical to the first front guide member, the first and second front guide members being arranged on either side of the actuator device.

Preferably, the rear guide device is similar to the front guide device.

Thus, the rear guide device includes at least one first rear guide member that is fastened to the rear anchor pad by a fastener portion, the first rear guide member being mounted on the frame so as to be slidable along a direction parallel to the deployment direction.

Advantageously, in order to further improve the ability to take up longitudinal forces, the rear guide device further includes a second rear guide member identical to the first rear guide member, the first and second guide members being arranged on either side of the actuator device.

Advantageously, the front and rear anchor pads are fastened to the actuator device in hinged manner. This hinging, comprising at least one pivot connection of horizontal axis, and preferably a ball joint connection, enables the front and rear anchor pads to take up positions parallel to the walls of the excavation. This has the effect of maximizing the contact area between the anchor pads and the walls of the excavation, thereby improving the anchoring of the anchor module in the excavation.

Preferably, with reference to the second embodiment, the front anchor pad is fastened to the front guide device in hinged manner, and the rear anchor pad is fastened to the rear guide device in hinged manner.

More preferably, each of the front and rear anchor pads is hinged relative to the first and second front and rear guide members.

Advantageously, the assembly constituted by the front anchor pad, the rear anchor pad, the front guide device, and the rear guide device forms a deformable trapezoid, the frame of the anchor module together with the drilling module being movable relative to said deformable trapezoid in the deployment direction. When the anchor pads are deployed, the deformable trapezoid constitutes a rigid single-piece structure serving to guide the movement of the drilling module relative to the walls of the excavation, which are not strictly vertical, to provide effective anchoring, and to do so while supporting the anchor module.

In a preferred embodiment, the actuator device comprises at least one jack. In a variant, the actuator device comprises two parallel jacks arranged side by side.

In another advantageous aspect of the invention, the drilling machine further comprises a movement device arranged between the anchor module and the drilling module to move the cutter members relative to the anchor module in the longitudinal direction of the drilling machine.

The cutter members are advantageously moved longitudinally after the anchor module has been anchored in the ground, thereby making it possible in particular to exert downwardly directed thrust on the cutter members. For this purpose, the movement device acts on the drilling module in order to move it downwards in the longitudinal direction. The drilling machine then presents a deployed position in which the cutter members are moved away from the anchor module, and a retracted position in which the cutter members are brought into the proximity of the anchor module.

Advantageously, the drilling module comprises a bottom section carrying the cutter members and a top section extending in the longitudinal direction, the top section of the drilling module being suspended from the bottom end of a lift cable.

It can be understood that in the invention the lift cable is fastened to the drilling module, unlike prior art Document EP 0 811 724, in which the lift cable is fastened to the anchor module. In the invention, actuating the lift cable serves to move the drilling module relative to the anchor module in the longitudinal direction, providing the anchor module is anchored in the ground.

An advantage is to reduce the load supported by the movement device when the anchor module is not anchored in the ground. The movement device carries only the anchor module, which is lighter than the drilling module.

Advantageously, the movement device comprises at least one thrust jack arranged between the frame of the anchor device and the bottom section of the drilling module, the top section of the drilling module being movable relative to the frame of the anchor device along said longitudinal direction.

It can be understood that actuating the thrust jack has the effect of lowering the bottom section of the drilling module carrying the cutter members, co-operation between the top section and the drilling module serving to guide the movement.

In a preferred variant, the top section is a bar that passes longitudinally through the anchor module. The bar is mounted to slide relative to the frame of the anchor device.

Advantageously, the anchor module includes a plurality of anchor elements, the frames of the anchor elements being secured to one another, in order to form a framework. The top section of the drilling module is preferably mounted to slide relative to the framework. For this purpose, the framework may include guide members forming sleeves in which the top section, and in particular the bar, is slidably mounted.

In an advantageous aspect of the invention, the anchor module further includes path correction means for causing the drilling module to pivot in a vertical plane.

Actuating the path correction means enables the position of the cutter members to be corrected by modifying the three-dimensional position of the drilling module in the excavation. After that, the anchor pads are deployed so as to hold the anchor module stationary in the ground. As a result of the front and rear anchor pads together with the actuator device being movable relative to the frame carrying the drilling module, the front and rear anchor pads move without moving the drilling module.

Thereafter, actuating the movement device has the effect of exerting thrust on the cutter members in a downward direction along the corrected drilling direction, thereby making it possible to continue drilling in the desired direction.

Advantageously, the path correction means comprise path correction pads that are deployable in a direction that extends transversely to the drilling module in order to bear against at least one of the walls of the excavation so as to cause the drilling module to pivot in the vertical plane.

When the path correction pad comes to bear in such a manner as to exert thrust against the excavation wall, that causes the drilling module to move in a direction opposite to the deployment direction of the path correction pad.

The path correction pads are arranged on the front face and the rear face of the drilling module.

Preferably, the path correction pads are arranged on the top section and/or on the bottom section of the drilling module.

In order to facilitate pivoting of the drilling module, the path correction pads are arranged on the front faces and rear faces of the top and bottom sections of the drilling module.

BRIEF DESCRIPTION OF THE DRAWINGS

The invention can be better understood on reading the following description of embodiments given as non-limiting examples, and with reference to the accompanying drawings, in which.

DETAILED DESCRIPTION OF THE INVENTION

Figure 1:
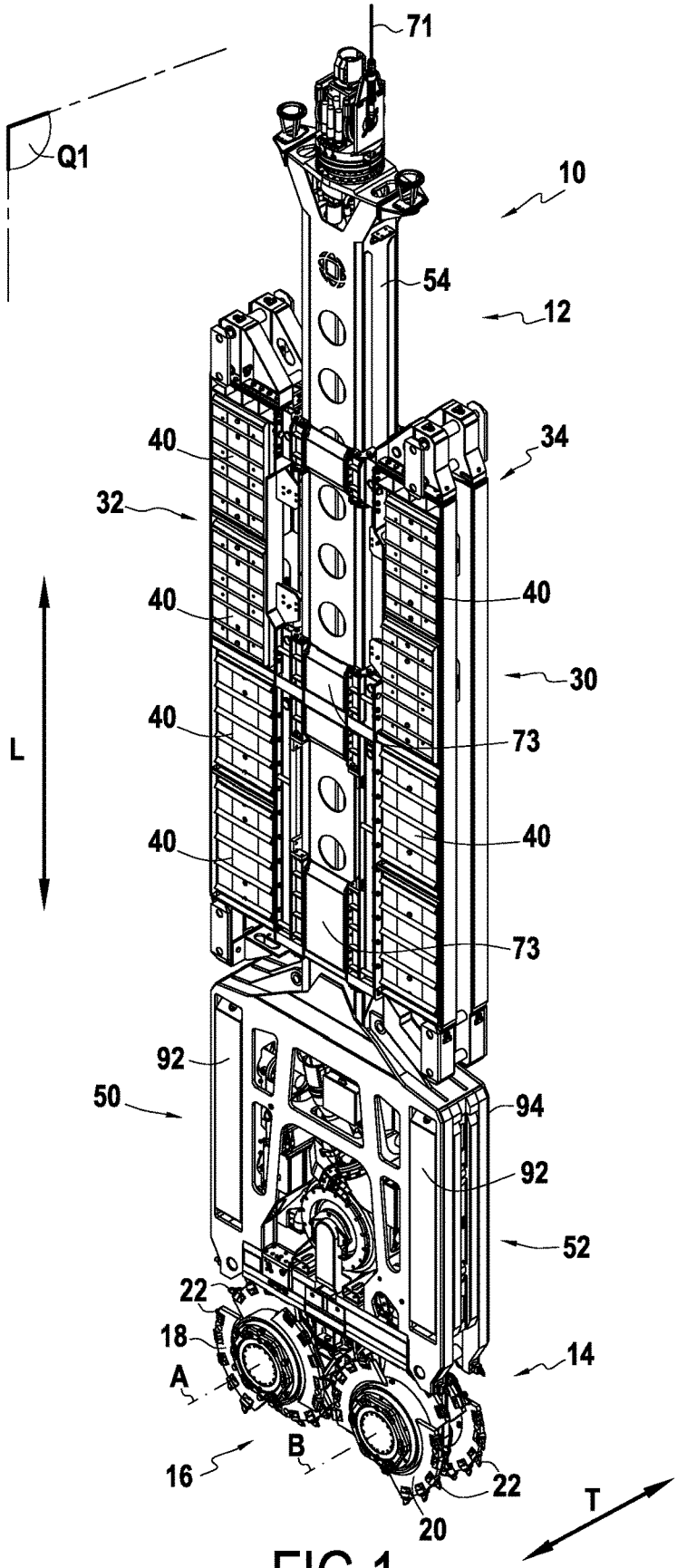
FIG. 1 is a perspective view of the drilling machine of the invention in the retracted position.
Figure 2:
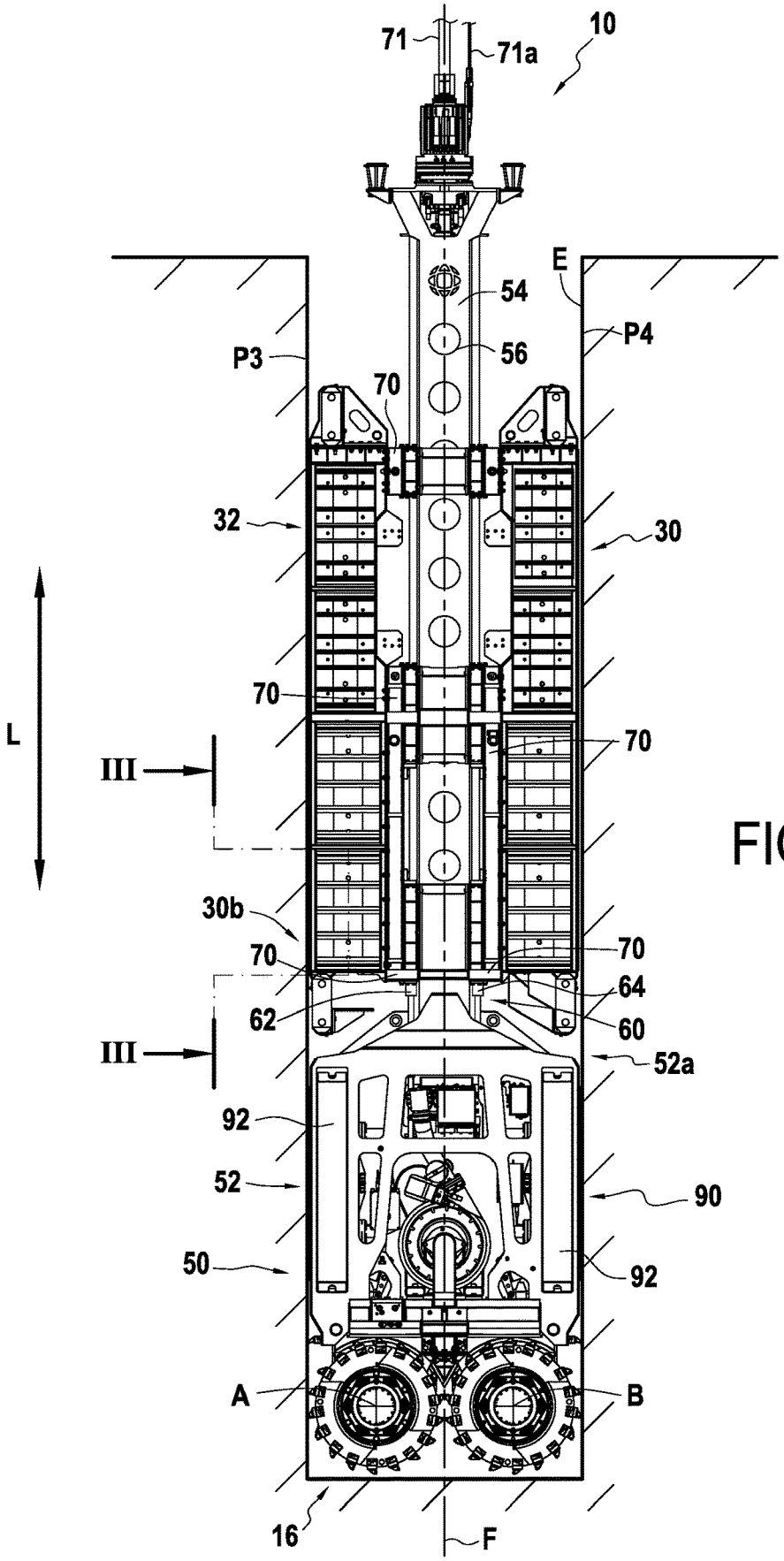
FIG. 2 shows the FIG. 1 drilling machine in face view.

FIGS. 1 and 2 show an example of a drilling machine 10 in accordance with the present invention. The drilling machine 10 is designed to make an excavation E in ground S in a drilling direction F that is substantially vertical. In other words, the drilling machine 10 of the invention is designed to make vertical trenches in the ground. The drilling machine 10 presents a longitudinal direction L that extends between a top portion 12 and a bottom portion 14 of the drilling machine 10.

As can be seen in FIG. 1, the bottom portion 14 is provided with cutter members 16 that, in this non-limiting example, comprise two pairs of drums 18 and 20 that are mounted to rotate about parallel axes of rotation A and B that are spaced apart. The axes of rotation A and B are orthogonal to the longitudinal direction L of the drilling machine 10. Furthermore, the pairs of drums 18 and 20 are provided at their peripheries with cutter teeth 22, themselves known. In other words, in this example, the drilling machine 10 is a milling machine adapted to make vertical trenches in the ground.

The drilling machine 10 also has an anchor module 30 that presents a front face 32 and a rear face 34 opposite from the front face 32. When the excavation machine is in the ground, the front and rear faces 32 and 34 face the larger walls P1 and P2 of the excavation E. The smaller walls P3 and P4 of the excavation are perpendicular to the larger walls P1 and P2 of the excavation E, and can be seen in FIG. 2.

The anchor module 30 has a plurality of anchor devices 40 that serve, when actuated, to hold the anchor module stationary in the ground. These anchor devices are described in greater detail below.

The drilling machine 10 also has a drilling module 50 that is arranged at the bottom portion 14 of the drilling machine, the drilling module 50 carrying the cutter members 16.

In this example, the drilling module 50 is movable in translation relative to the anchor module along the longitudinal direction L. In order to move the drilling module 50 relative to the anchor module 30, the drilling machine 10 also has a movement device 60 that is arranged between the anchor module 30 and the drilling module 50. In this example, the movement device 60 is constituted by two thrust jacks 62 and 64 that serve to exert thrust on the cutter members 16 when the anchor module is anchored in the ground, this thrust in the longitudinal direction being directed downwards.

The drilling module 50 also has a bottom section 52 that carries the cutter members, and a top section 54 that extends from a top end 52*a* of the bottom section of the drilling module 50 in the longitudinal direction L. Furthermore, as can be seen in FIG. 2, the top section 54 of the drilling module 50 is a bar 56 that passes longitudinally through the anchor module 30. With reference to FIG. 2, it can also be seen that the top section 54 of the drilling module 50 is suspended from the bottom end 71*a* of a lift cable 71. The lift cable is connected at its top end to a carrier boom (not shown), itself known.

It can be understood that the movement device 60, in particular the thrust jacks 62, 64, is arranged between a bottom end 30*b* of the anchor module 30 and the top end 52*a* of the bottom section 50 of the bottom section 52 of the drilling module 50.

Figure 3:
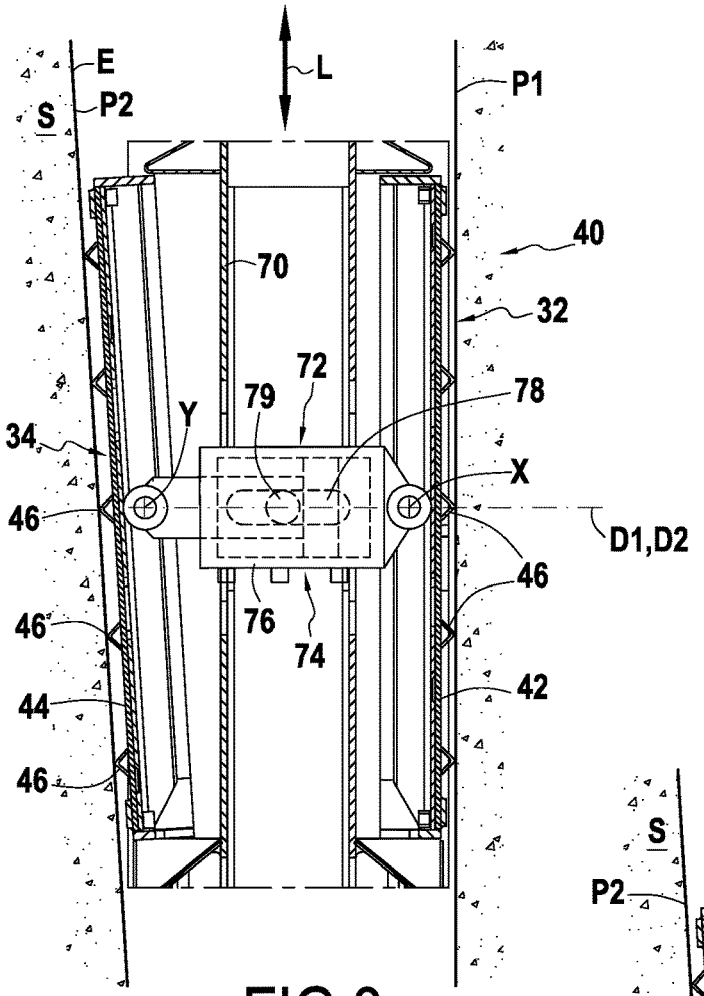
FIG. 3 is a side view in section on of an anchor device in a first embodiment of the drilling machine.

With reference to FIG. 3, there follows a description in greater detail of the anchor device 40 corresponding to a first embodiment of the invention.

Each anchor element 40 comprises a front anchor pad 42 arranged on the front face 32 of the anchor module 30, and a rear anchor pad 44 arranged on the rear face 34 of the anchor module 30. As can be understood from FIG. 3, the front and rear anchor pads are deployable in a deployment direction D that is transverse to the longitudinal direction L of the drilling machine 10. The front and rear anchor pads 42 and 44 present both a retracted position and a deployed position, as shown in FIG. 3 where the anchor pads are bearing against the larger walls P1 and P2 of the excavation E in order to hold the anchor module 30 stationary in the ground S.

In order to improve the anchoring, the front and rear anchor pads are provided with spikes 46 in this example, which spikes are arranged on the outer faces of the anchor pads that face the walls.

The anchor device 40 also has a frame 70 that carries the front and rear anchor pads 32 and 34. As can be understood from FIG. 2, the frame 70 is fastened to the movement means 60 so that the frame 70 supports the drilling module 50; more precisely, in the non-limiting example of FIG. 2, the anchor module 30 has a plurality of anchor devices 40 with their frames 70 secured to one another so as to form a framework that supports the drilling module 50 via the movement device 60, and specifically via the thrust jacks 62, 64. It can thus be understood that when the drilling machine is suspended in the air at the end of the lift cable 71, the thrust jacks 62 and 64 carry only the weight of the anchor module.

With reference once more to FIG. 3, it can be seen that the anchor device 40 also has an actuator device 72 to which the front and rear anchor pads 32 and 34 are fastened. In this example, the actuator device 72 is a hydraulic jack 74 that comprises a cylinder 76 fastened to the front anchor pad 42 and a rod 78 fastened to the rear anchor pad 44. In this first embodiment, the cylinder 76 of the jack 74 is fastened slidably to the frame 70 to slide in a direction that is transverse relative to the longitudinal direction of the drilling machine; specifically, this is the deployment direction. The hydraulic jack 74 forms a sliding connection with the frame 70 that extends in the deployment direction.

For this purpose, the cylinder 76 includes a slot 78 that co-operates with a guide finger 79 of the frame 70.

The actuator device 72 presents a retracted state in which the front and rear anchor pads 42 and 44 are retracted, and a deployed state, as shown in FIG. 3, in which the front and rear anchor pads 42 and 44 are deployed. The actuator device 72 is thus adapted to act on the front and rear anchor pads 42 and 44 while being movable relative to the frame 70 in a movement direction D2 that extends transversely relative to the longitudinal direction of the drilling machine. In this example, the movement direction D2 corresponds to the deployment direction D1.

It can thus be understood that the assembly constituted by the front anchor pad 42, the rear anchor pad 44, and the actuator device 72 (the jack 74) is movable relative to the frame 70 and to the drilling module in the movement direction D2.

With reference once more to FIG. 3, it can be seen that in this first embodiment each of the front and rear anchor pads 42 and 44 is fastened to the actuator device 72 in hinged manner. More precisely, the front anchor pad 42 is mounted to pivot about a substantially horizontal axis X relative to the actuator device 72. In similar manner, the rear anchor pad 44 is likewise pivotally mounted about an axis Y relative to the actuator device 72.

As can be understood from FIG. 3, the hinge assembly serves advantageously to enable the front and rear anchor pads 42 and 44 to slope and bear flat against the walls P1 and P2 of the excavation E, which walls are not necessarily strictly vertical, particularly if the drilling path has deviated relative to the desired path, and that they need not be parallel to each other.

Figure 4:
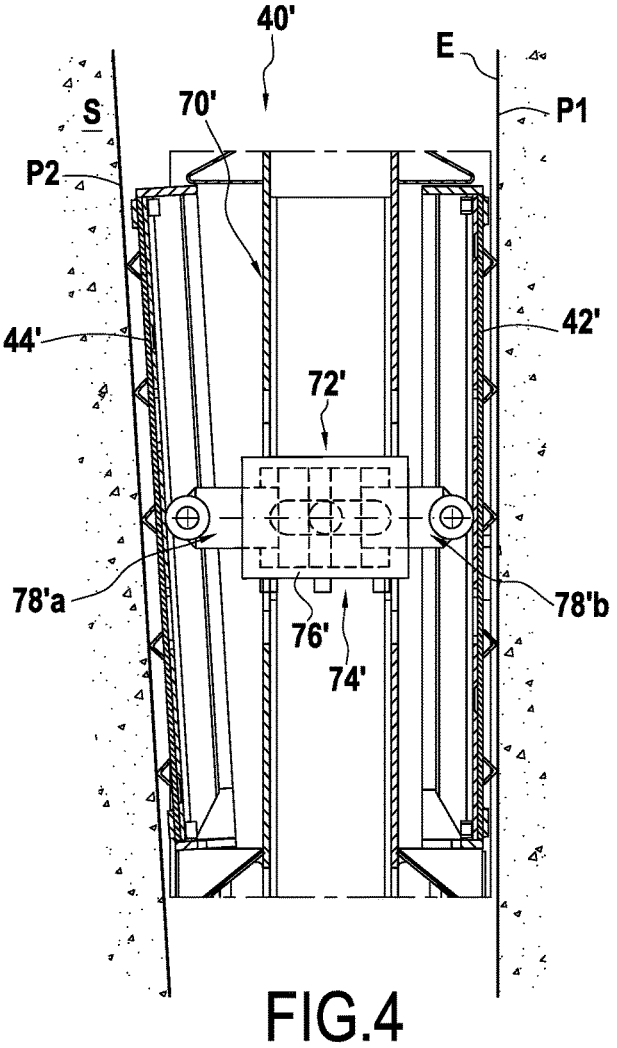
FIG. 4 shows a variant of the FIG. 3 anchor device.

The anchor device 40' shown in FIG. 4 is a variant of the anchor device 40 shown in FIG. 3. The variant of FIG. 4 differs from the device of FIG. 3 by the fact that the actuator device 72' is an jack 74' having a cylinder 76' that is movably connected to the frame 70' and that has two rods 78'*a* and 78'*b* on a common axis. The first rod 78'*a* is fastened to the front anchor pad 42' in hinged manner, while the second rod 78'*b* is fastened to the rear anchor pad 44' in hinged manner. During actuation of the actuator device 72', the first and second rods 78'*a* and 78'*b* are deployed in opposite directions so as to bring the front and rear anchor pads against the walls P1 and P2 of the excavation.

Figure 6:
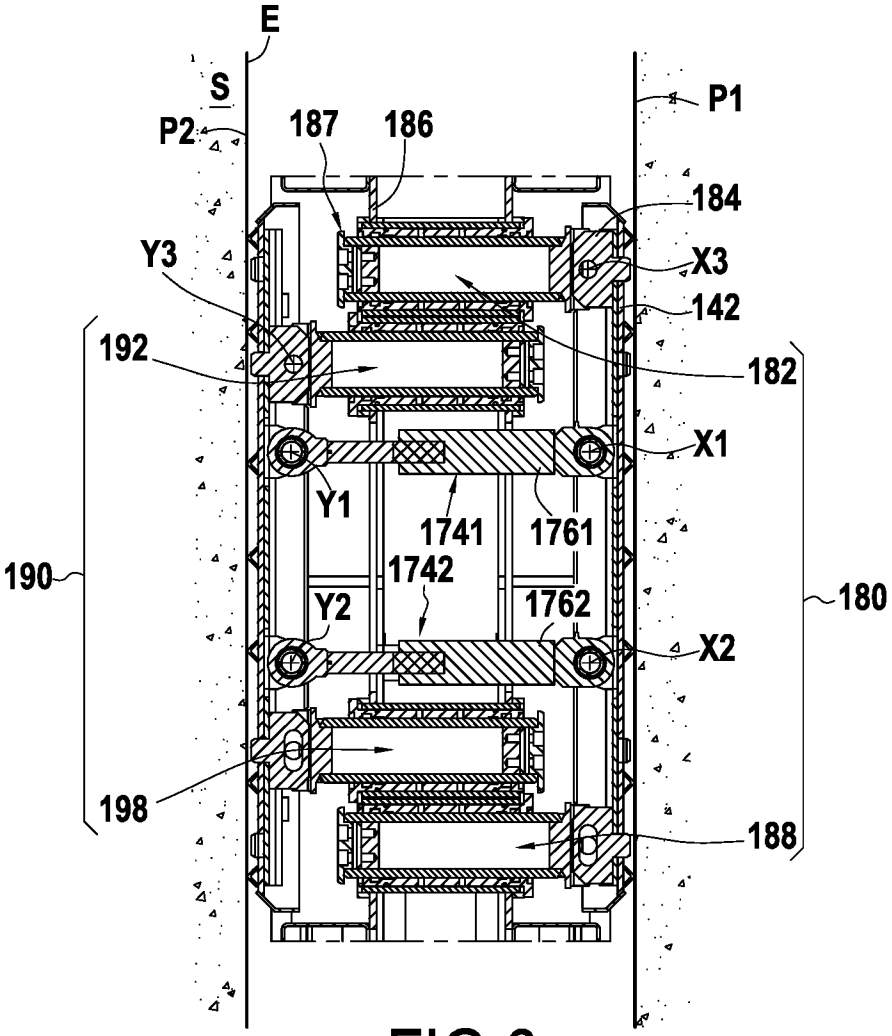
FIG. 6 is a side view in section of the FIG. 5 anchor device, the front and rear anchor pads being deployed and parallel.
Figure 5:
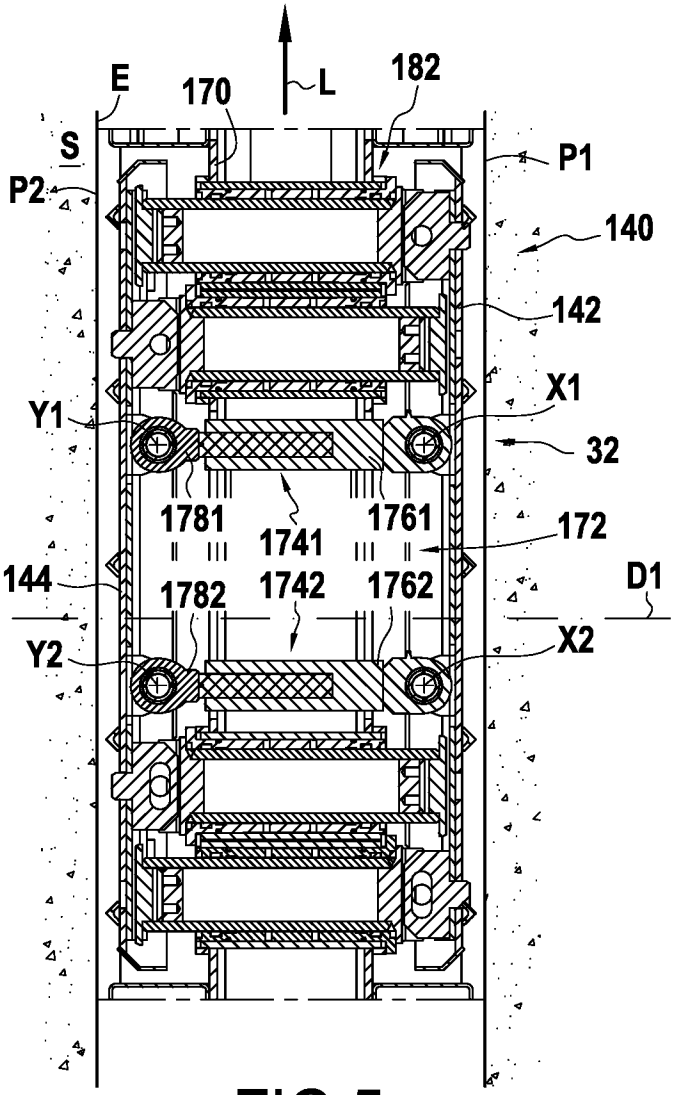
FIG. 5 is a side view in section of an anchor device in a second embodiment of the drilling machine of the invention, the anchor pads being retracted.
Figure 7:
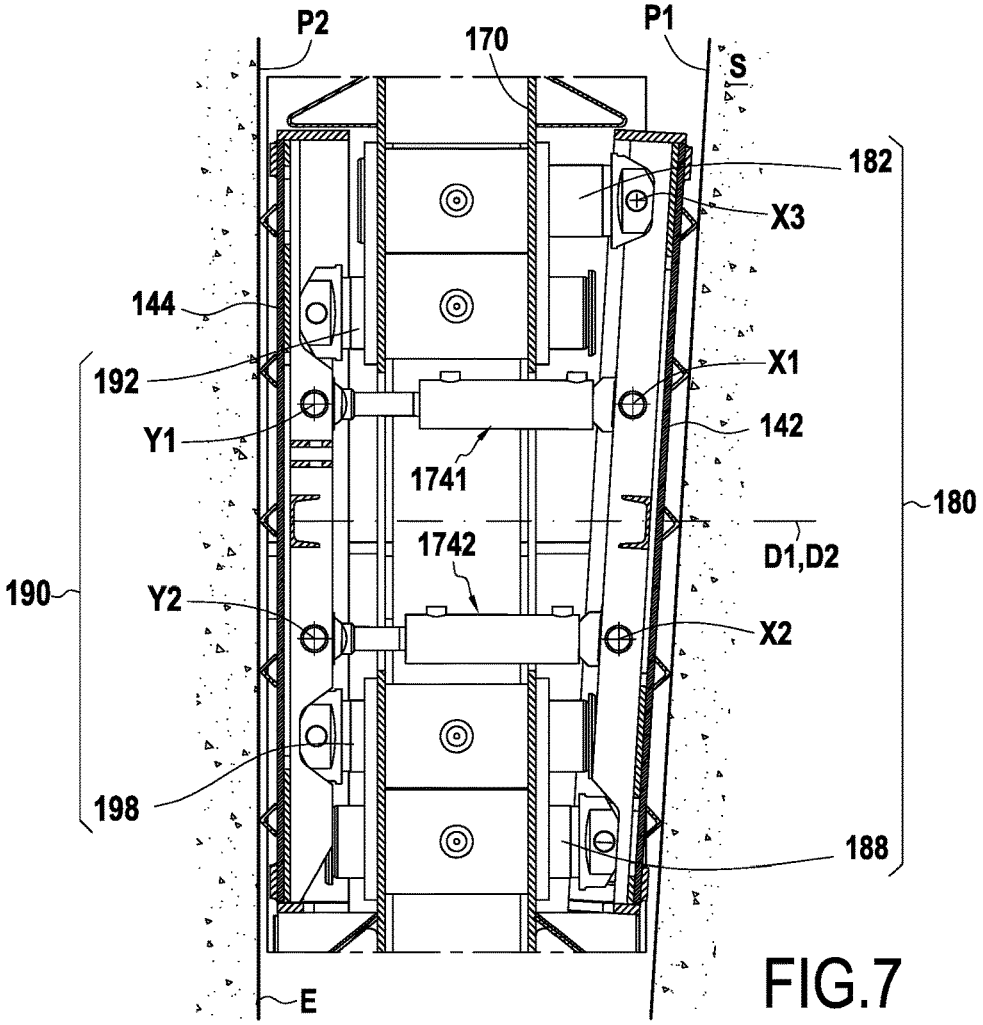
FIG. 7 shows the FIG. 6 anchor device, with one of the anchor pads sloping relative to the other anchor pad.

With reference to FIGS. 5 to 7, there follows a description of a second embodiment of the anchor device 140 of the invention.

The anchor device 140 has a front anchor pad 142 that is arranged in the front face 32 of the drilling module 30 of the FIG. 1 drilling machine 10, and a rear anchor pad 144 that is arranged in the rear face 34 of the drilling module 30 of the FIG. 1 drilling machine 10. In similar manner to the first embodiment, the front and rear anchor pads are deployable in a deployment direction D1 that extends transversely relative to the longitudinal direction L of the drilling machine 10, so as to bear against the walls P1 and P2 of the excavation E in order to hold the anchor module stationary in the ground.

The anchor device 140 also has a frame 170 that supports the drilling module 50 via the above-described movement device 60.

The anchor device 140 also has an actuator device 172 that has the front and rear anchor pads 142 and 144 fastened thereto.

In this second embodiment, the actuator device 172 has a first jack 1741 and a second jack 1742, each of the first and second jacks 1741 and 1742 having a respective rod 1781, 1782 that is fastened in hinged manner to the rear anchor pad 144 via pivot connections of substantially horizontal axes Y1, Y2. The first and second jacks 1741, 1742 have respective cylinders 1761, 1762 that are fastened in hinged manner to the front anchor pad 142 via pivot connections of axes X1 and X2 that are substantially horizontal.

The actuator device 172 presents a retracted state, shown in FIG. 5, in which the front and rear anchor pads 142 and 144 are retracted, and a deployed state, shown in FIG. 6. In accordance with the invention, the actuator device 172 is movable relative to the frame 170 in the movement direction D2, which in this example coincides with the deployment direction D1.

Unlike the first embodiment, the actuator device 172 is not directly connected to the frame 170.

Without going beyond the ambit of the invention, the actuator device 172 could have only one jack.

As can be seen in FIG. 5 and FIG. 6, in this second embodiment, the anchor device also has a front guide device 180 for guiding the movement of the front anchor pad 142 relative to the frame 170 in the deployment direction D1. The front guide device 180 has a first front guide member 182 that is fastened to the front anchor pad 142 by a fastener portion 184. The first front guide member 182 is mounted on the frame 170 so as to be slidable in the deployment direction D1. To do this, the first front guide member 182 is slidably mounted in an orifice 186 provided in the frame 170. The first front guide member 182 also has an abutment 187 that is arranged at the end of the first front guide member 182 that is opposite from the fastener portion 184. This abutment serves to avoid the first front guide member from escaping from the frame. In addition, the first front guide member 182 is fastened to the front anchor pad 142 in hinged manner via a pivot connection having its axis of rotation X3 parallel to the above-described axes X1 and X2.

The front guide device 180 also has a second front guide member 188 that is identical to the first front guide member 182, the first and second front guide members 180 and 188 being arranged on either side of the actuator device 172. It is specified that the second front guide member 188 is likewise fastened to the front anchor pad 142 in hinged manner.

Insofar as the first and second front guide members are slidably mounted in the frame 170, the hinge between the second front guide member 188 and the front anchor pad 142 is adapted to allow a small amount of movement in translation along the longitudinal direction L so as to allow the front anchor pad to slope relative to the rear anchor pad.

The anchor device 140 also has a rear guide device 190 for guiding movement of the rear anchor pad 144 relative to the frame 170 in the deployment direction D1. The rear guide device 190 is very similar to the front guide device 180, so it is described more distinctly. The rear guide device comprises a first rear guide member 192 that is fastened to the rear anchor pad 144 in hinged manner about an axis of rotation Y3 parallel to the axes Y1 and Y2, the first rear guide member 192 also being mounted on the frame 170 so as to be slidable along the deployment direction D1. The rear guide device 190 also has a second rear guide member 198 identical to the first rear guide member 192, the first and second rear guide members being arranged on either side of the actuator device 172. In addition, in this second embodiment, the first and second front guide members 182 and 188 are arranged on either side of the first and second rear guide members 192 and 198.

FIG. 7 shows the situation in which the excavation walls P1 and P2 are not strictly vertical, nor exactly parallel to each other. After actuating the actuator device 172, the front and rear anchor pads 142 and 144 take up flat positions against the walls P1 and P2 of the excavation; insofar as the wall P1 is not parallel to the wall P2, it can be understood that the front and rear anchor pads 142 and 144 slope relative to each other. Furthermore, the assembly constituted by the front anchor pad 142, the rear anchor pad 144 of the front guide device 180, and in particular the first and second front guide members and the guide device 190, and in particular the first and second rear guide members, forms a trapezoid.

Insofar as the frame 170 is mounted to slide along the deployment direction D1 relative to the first and second front and rear guide members 182, 188, 192, 198, it can be understood that the frame 170 can move in the deployment direction D1, which then constitutes the movement direction D2 even while the anchor module is anchored in the ground. As a result, the frame 170 of the anchor module 30 with the drilling module 50 can be moved relative to the trapezoid in the movement direction D2.

Figure 8:
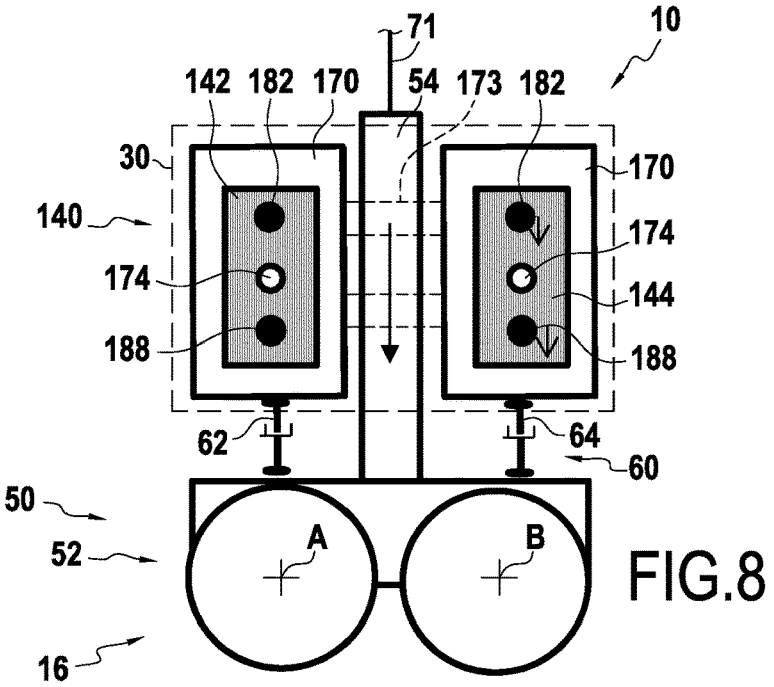
FIG. 8 is a diagram showing the drilling machine of the invention in face view.

FIG. 8 is a diagram showing a drilling machine 10 of the invention that has two anchor devices 140 such as those shown in FIGS. 5 to 7, except that the actuator device of each of the anchor devices has only one jack, given reference 174.

With reference to FIG. 8, it can be understood that the frames 170 of the anchor devices 140 carry the drilling module 50, and in particular the bottom section 52. It can also be understood that the drilling module 50 is mounted to slide relative to the anchor module 30. As can be understood from FIG. 8, the frames 170 of the anchor devices are preferably secured to one another by connection members 73 that serve to improve the stiffness of the anchor module.

With reference once more to FIGS. 1 and 2, it can be seen that the drilling module 50 also has path correction means 90 for causing the drilling module to pivot in a vertical plane Q1 that is parallel to the axes of rotation A, B of the drums 18, 20.

These path correction means 90 comprise first path correction pads 92 arranged on the front face of the bottom section that can be deployed in a direction T parallel to the axis of rotation A, B of the drums in order to bear against at least one of the walls P1, P2 of the excavation E in order to cause the drilling module to pivot in the vertical plane Q1. In this example, the path correction means 90 also include second path correction pads 94 arranged on the rear face of the bottom section 52 of the drilling module 50. The deployable pads 92, 94 are arranged in this example on the bottom section of the drilling module. Other deployable pads could also be provided arranged on the top section of the drilling module, in order to facilitate pivoting the drilling module in the vertical plane Q1.

With reference to FIGS. 9A to 10D, there follows a more detailed description of how the path correction means operate.

Figures 9A, 9B, 9C, 9D:
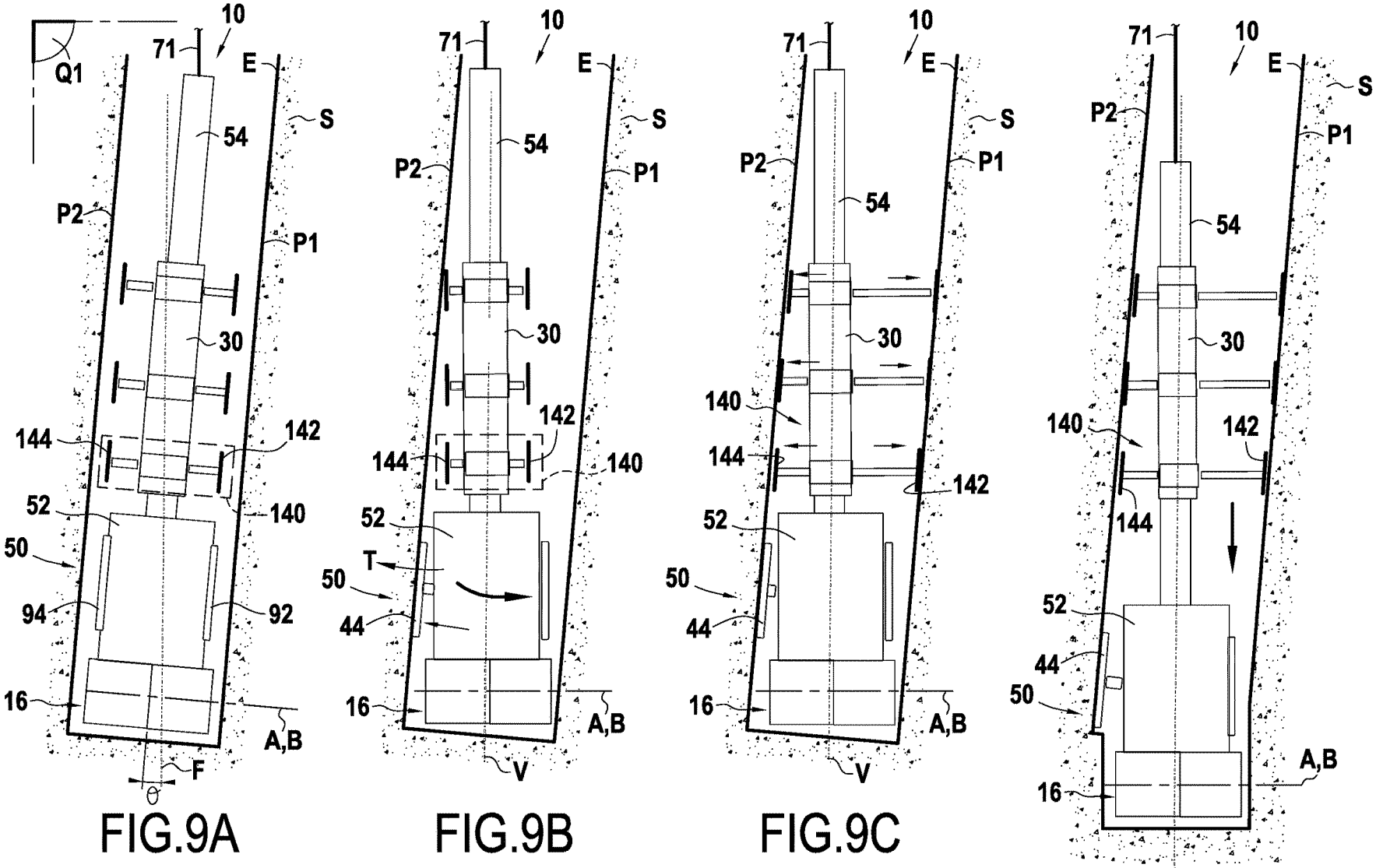
FIGS. 9A to 9D are diagrams showing the path of the drilling machine of the invention being corrected and the machine being anchored.
Figure 10A:
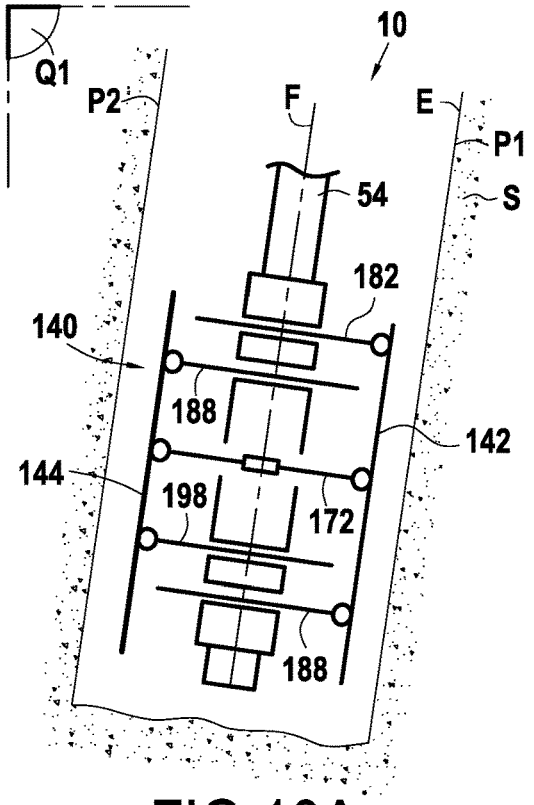
FIGS. 10A to 10D are diagrams showing the operation of the anchor elements of the FIG. 8 machine.
Figure 10B:
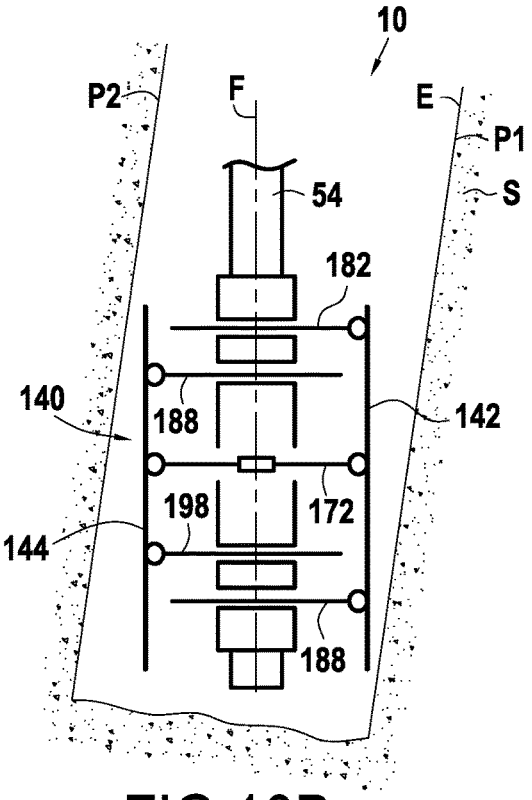
Figure 10C:
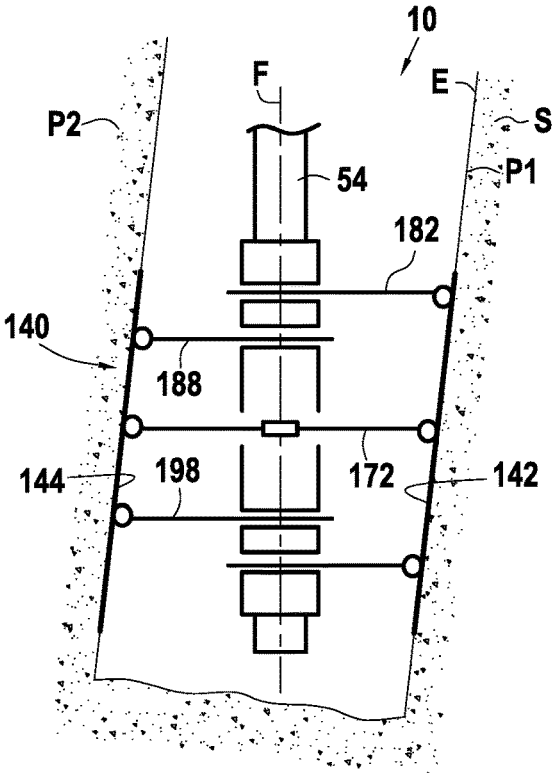
Figure 10D:
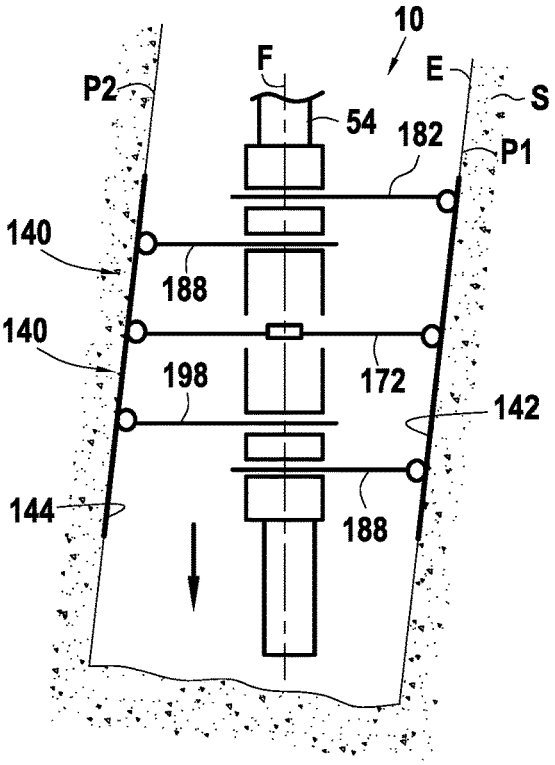

In the example of FIG. 9A, the drilling path F of the drilling machine 10 has deflected through an angle θ relative to the vertical direction V. With the anchor devices in their retracted position, the path correction means are actuated, and more particularly the rear pad 94, which bears against the wall P2 of the excavation E, thus causing the drilling machine suspended from the cable 71 to tilt in the vertical plane Q1. After the drilling direction F, which corresponds to the longitudinal direction L of the drilling machine, has been repositioned in the vertical direction V, the anchor devices 140 are actuated, as shown in FIG. 9C, so as to hold the anchor module 30 stationary in the excavation E. As explained above, the actuation of the anchor devices 140, which causes the deployable anchor pads 142, 144 to be deployed, and possibly causes the actuator device to be moved, is performed without changing the position of the frame 170 or of the drilling module 50 relative to the walls of the excavation.

After anchoring the anchor module 30, the movement device is actuated so as to exert downwardly-directed thrust on the cutter members 16 so as to continue drilling in a corrected drilling direction F, which is now vertical.

FIGS. 10A to 10D show in detail the drilling device 140 of the anchor module 30, corresponding to the positions of the drilling machine shown in FIGS. 9A to 9D.

The invention claimed is:

1. A drilling machine for making an excavation in ground along a substantially vertical drilling direction, the drilling machine having a bottom portion provided with cutter members and a top portion, the drilling machine presenting a longitudinal direction extending between the top portion and the bottom portion of the drilling machine, said drilling machine comprising:

an anchor module having a front face and a rear face, the anchor module comprising at least one anchor device having at least one front anchor pad arranged on the front face and at least one rear anchor pad arranged on the rear face, the front and rear anchor pads being deployable in a deployment direction that extends transversely to the longitudinal direction of the drilling machine so as to bear against walls of the excavation in order to hold the anchor module stationary in the ground; and a drilling module carrying the cutter members, the drilling module co-operating with the anchor module;

wherein the anchor device further comprises:

a frame carrying the front and rear anchor pads, the frame supporting the drilling module; and an actuator device, including at least one jack, to which the front and rear anchor pads are fastened, the actuator device presenting a retracted state in which the front and rear anchor pads are retracted, and a deployed state in which the front and rear anchor pads are deployed, the actuator device acting on the front and rear anchor pads while being movable relative to the frame in a movement direction that extends transversely relative to the longitudinal direction;

whereby the assembly constituted by the front anchor pad, the rear anchor pad, and the actuator device is movable in the movement direction relative to the frame and to the drilling module.

2. The drilling machine according to claim 1, wherein the actuator device includes a body that is fastened to the frame so as to be movable in a direction parallel to the movement direction.

3. The drilling machine according to claim 1, wherein the anchor device further comprises:

a front guide device for guiding the movement of the front anchor pad relative to the frame in the deployment direction; and/or a rear guide device for guiding the movement of the rear anchor pad relative to the frame in the deployment direction.

4. The drilling machine according to claim 3, wherein the front guide device includes at least a first front guide member that is fastened to the front anchor pad, the first front guide member being mounted to the frame so as to be slidable along the deployment direction.

5. The drilling machine according to claim 4, wherein the front guide device further includes a second front guide member identical to the first front guide member, the first and second front guide members being arranged on either side of the actuator device.

6. The drilling machine according to claim 3, wherein the rear guide device includes at least a first rear guide member that is fastened to the rear anchor pad, the first rear guide member being mounted on the frame so as to be slidable along the deployment direction.

7. The drilling machine according to claim 6, wherein the rear guide device further includes a second rear guide member identical to the first rear guide member, the first and second guide members being arranged on either side of the actuator device.

8. The drilling machine according to claim 3, wherein each of the front and rear anchor pads is fastened to the actuator device in hinged manner.

9. The drilling machine according to claim 8, wherein the front anchor pad is fastened to the front guide device in hinged manner, and wherein the rear anchor pad is fastened to the rear guide device in hinged manner.

10. The drilling machine according to claim 9, wherein each of the front and rear anchor pads is hinged relative to the first and second front and rear guide members.

11. The drilling machine according to claim 9, wherein the assembly constituted by the front anchor pad, the rear anchor pad, the front guide device, and the rear guide device forms a deformable trapezoid, the frame of the anchor module together with the drilling module being movable relative to said deformable trapezoid in the deployment direction.

12. The drilling machine according to claim 1, wherein the drilling module is movable relative to the anchor module in the longitudinal direction, and wherein said machine further comprises at least one movement device arranged between the anchor module and the drilling module to move the cutter members relative to the anchor module in the longitudinal direction.

13. The drilling machine according to claim 1, wherein the drilling module comprises a bottom section carrying the cutter members and a top section extending in the longitudinal direction, and wherein the top section of the drilling module is suspended from the bottom end of a lift cable.

14. The drilling machine according to claim 13, wherein the movement device comprises at least one thrust jack arranged between the frame of the anchor device and the bottom section of the drilling module, the top section of the drilling module being movable relative to the frame of the anchor device along said longitudinal direction.

15. The drilling machine according to claim 13, wherein the top section comprises a bar passing longitudinally through the anchor module.

16. The drilling machine according to claim 1, wherein the anchor module includes a plurality of anchor devices, the frames of the anchor devices being secured to one another.

17. The drilling machine according to claim 1, wherein the anchor module further includes a path correction device for causing the drilling module to pivot in a vertical plane.

18. The drilling machine according to claim 17, wherein the path correction device comprises path correction pads that are deployable in a direction that extends transversely to the drilling module in order to bear against at least one of the walls of the excavation so as to cause the drilling module to pivot in the vertical plane.

19. The drilling machine according to claim 13, wherein the path correction pads are arranged on the top section and/or on the bottom section of the drilling module.

20. The drilling machine according to claim 1, wherein said drilling machine is a milling machine having cutter members that comprise drums that are rotatable about axes of rotation that are parallel, distinct, and perpendicular to the drilling direction.

21. The drilling machine according to claim 1, wherein each of the front and rear anchor pads is fastened to the actuator device in hinged manner.

22. A drilling machine for making an excavation in ground along a substantially vertical drilling direction, the drilling machine having a bottom portion provided with cutter members and a top portion, the drilling machine presenting a longitudinal direction extending between the top portion and the bottom portion of the drilling machine, said drilling machine comprising:

an anchor module having a front face and a rear face, the anchor module comprising at least one anchor device having at least one front anchor pad arranged on the front face and at least one rear anchor pad arranged on the rear face, the front and rear anchor pads being deployable in a deployment direction that extends transversely to the longitudinal direction of the drilling machine so as to bear against walls of the excavation in order to hold the anchor module stationary in the ground; and a drilling module carrying the cutter members, the drilling module co-operating with the anchor module;

wherein the anchor device further comprises:

a frame carrying the front and rear anchor pads, the frame supporting the drilling module; and an actuator device to which the front and rear anchor pads are fastened, the actuator device presenting a retracted state in which the front and rear anchor pads are retracted, and a deployed state in which the front and rear anchor pads are deployed, the actuator device acting on the front and rear anchor pads while being movable relative to the frame in a movement direction that extends transversely relative to the longitudinal direction;

whereby the assembly constituted by the front anchor pad, the rear anchor pad, and the actuator device is movable relative to the frame and to the drilling module in the movement direction;

wherein the anchor device further comprises:

a front guide device for guiding the movement of the front anchor pad relative to the frame in the deployment direction;

and wherein the front guide device includes at least a first front guide member that is fastened to the front anchor pad, the first front guide member being mounted to the frame so as to be slidable along the deployment direction.

* * * * *